US006269623B1

(12) United States Patent
Phoa et al.

(10) Patent No.: US 6,269,623 B1
(45) Date of Patent: Aug. 7, 2001

(54) OPEN-END ROTOR SPINNING ARRANGEMENT

(75) Inventors: Tek Tjin Phoa, Stolberg; Jürgen Meyer, Aachen, both of (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/688,897

(22) Filed: Oct. 16, 2000

(30) Foreign Application Priority Data

Oct. 14, 1999 (DE) ..... P 199 49 533

(51) Int. Cl.[7] ..... D01H 4/40
(52) U.S. Cl. ..... 57/417
(58) Field of Search ..... 57/400, 404, 406, 57/414, 417

(56) References Cited

U.S. PATENT DOCUMENTS

| | | | | |
|---|---|---|---|---|
| 3,778,989 | * | 12/1973 | Schon | 57/414 |
| 3,834,147 | | 9/1974 | Havranek et al. | 57/58 |
| 4,110,961 | * | 9/1978 | Havel et al. | 57/414 |
| 4,385,488 | * | 5/1983 | Raasch et al. | 57/414 |
| 4,791,781 | | 12/1988 | Phoa et al. . | |

FOREIGN PATENT DOCUMENTS

| | | | | |
|---|---|---|---|---|
| 676608 | * | 2/1991 | (CH) | 57/414 |
| 2 351 561 | | 9/1974 | (DE) . | |
| 25 44 721 A1 | | 5/1980 | (DE) . | |
| 34 45 911 A1 | | 6/1986 | (DE) . | |
| 36 34 567 A1 | | 10/1987 | (DE) . | |
| 39 34 166 A1 | | 4/1991 | (DE) . | |
| 0 422 615 A2 | | 10/1990 | (EP) . | |
| 63006121 | * | 1/1988 | (JP) | 57/414 |

* cited by examiner

*Primary Examiner*—Danny Worrell
(74) *Attorney, Agent, or Firm*—Kennedy Covington Lobdell & Hickman, LLP

(57) ABSTRACT

An open-end spinning arrangement having a yarn withdrawal nozzle (10), by means of which the yarn is withdrawn form its transition zone within the spinning rotor and is rollingly and slidingly deflected while circulating in contact with the yarn withdrawal nozzle, additionally imparting a false twist. The yarn withdrawal nozzle has a depression (24), which is abruptly offset in the circulating direction of the yarn, by which the yarn loses contact with the yarn withdrawal nozzle (10) in the withdrawal direction of the yarn and over an angular area a of at least 10 degrees. Each time the rotating yarn tail sweeps over this depression, the false twist is completely interrupted and the actual twisting of the yarn at the yarn withdrawal nozzle (10) is cancelled. Yarns spun by means of such yarn withdrawal nozzles (10) have a looser yarn structure and a clearly reduced number of wrap fibers, and make the employment of rotor-spun yarns possible in applications in which preferably voluminous and soft yarns are processed.

10 Claims, 5 Drawing Sheets

OPEN-END ROTOR SPINNING ARRANGEMENT

CROSS-REFERENCE TO RELATED APPLICATIONS

This application claims the benefit of German Patent Application DE P 19949533.5, filed Oct. 14, 1999, herein incorporated by reference.

FIELD OF THE INVENTION

The present invention relates to open-end spinning arrangements. More particularly, the present invention relates to an open-end spinning arrangement basically having a rotatable spinning rotor, a fiber guide conduit with an exit mouth for delivery of spinning fibers into the spinning rotor, and a yarn withdrawal nozzle for withdrawing a yarn formed of the fibers from a transition zone within the spinning rotor and simultaneously for rollingly and slidingly deflecting the yarn over a yarn contact surface of the yarn withdrawal nozzle to impart a false twist thereto. In the present invention, the yarn withdrawal nozzle has a means for reducing the false twist within a zone extending over a circumferential portion of the yarn withdrawal nozzle, the false twist reducing means and the exit mouth of the fiber guide conduit being arranged relative to the direction of the rotor rotation such that actual twisting of the yarn is reduced thereat.

BACKGROUND OF THE INVENTION

When producing yarns in accordance with an open-end spinning process, the yarn is drawn out of the interior of the rotor via a withdrawal nozzle. A yarn tail turns because of the rotation of the rotor and provides the yarn with a real twist. Because of the rolling and sliding movement of the yarn over the surface of the withdrawal nozzle, a temporary twisting (i.e., a false twist) in the same direction is simultaneously generated. It is possible to improve the spinning stability during the open-end spinning process by an increase of the false twist. In accordance with the principle of the twisting compensation in the tensed yarn, both portions of the twist are propagated opposite to the yarn withdrawal direction in the yarn as far as the rotor groove and produce the transition zone thereat.

The length of the transition zone has an effect on the formation of wrap fibers, or so-called belly bands. Wrap fibers are individual fibers which have not been, or only incompletely have been, twisted into the yarn core, and which then are wound in alternating directions of rotation partially loosely, partially quite tightly, around the yarn periphery. Wrap fibers are increasingly formed by an increase in false twists, and the formation of such wrap fibers also takes place unevenly. The yarn structure suffers from this effect, and the range of application of open-end rotor yarns is limited.

It is known from German Patent Publication DE 39 34 166 A1 to affect the production of yarn in respect to spinning stability and hairiness by means of a suitable design of the withdrawal nozzle, and thereby to affect the formation of false twists. The yarn withdrawn from the rotor rolls over the surface of the orifice funnel of the yarn withdrawal conduit and receives a false twist in the process. This false twist formation is reduced respectively during and after passing notches in the yarn withdrawal nozzle, which essentially extend in the yarn withdrawal direction. In the deflecting area, the yarn is always at least partially in contact with the surface of the yarn withdrawal nozzle. Protrusions, which are arranged exactly in the center between two notches, are intended to have the effect of napping the yarn, while simultaneously providing good spinning stability. A regularly alternating contact of the yarn between the notch and the protrusion is intended to permit stable spinning on the one hand, and to cause a desired hairiness in yarn on the other hand. The yarn is plucked and thereby brought into a hairy state. Hairiness is partially caused in that outer fibers, which are not completely bound up in the yarn, are partially released from the yarn bundle and project outward. The notches or grooves cause the yarn to oscillate. The yarn oscillations are propagated as far as into the rotor groove and affect the spinning stability, the yarn structure and the yarn quality.

German Patent Publication DE 36 34 567 A1 discloses a device for drawing the yarn out of the yarn collector groove of the rotor of an open-end spinning arrangement. The surface of the yarn withdrawal nozzle, on which the yarn slidingly rolls, has sectors in the circumferential direction, in which the coefficient of friction is less than in the remaining sector or sectors. Because of the reduced friction, the yarn is given a lesser amount of false twist than outside of feeding fiber zone. Customarily, the fiber feeding zone is defined by the position of the fiber guide conduit and its orifice. The false twist is imparted to the yarn at the withdrawal nozzle. However, the wrap fibers, or so-called belly bands, are predominantly formed in the transition zone, i.e. in the rotor groove or in fiber feeding zone. The sector with the locally limited change of the coefficient of friction between the yarn and the withdrawal nozzle surface is positioned in respect to the location of fiber delivery in such a way that the reduction of false twist formation in the course of the passage of the yarn through fiber feeding zone takes place in the rotor groove.

The separation point of the yarn from the rotor groove is the location in which the yarn undergoes the greatest stress during withdrawal. The extent of yarn between the rotor groove and the deflecting zone caused by the withdrawal nozzle is subjected to greater twisting by the false twist than would result by the rotor rotation alone. The increased twisting imparted at the separation point results in an improvement of the spinning stability. Therefore the maintenance of a false twist formation is usually desired.

OBJECT AND SUMMARY OF THE INVENTION

An object of the invention is therefore to lower the probability of the formation of undesired wrap fibers or so-called belly bands. In accordance with the invention, this object is attained by an open-end rotor spinning arrangement wherein the yarn withdrawal nozzle of the spinning arrangement has a depression in the yarn contact surface of the yarn withdrawal nozzle which is abruptly offset in the circumferential direction of the yarn withdrawal nozzle and which has a depth and an extent in the circumferential direction of the yarn withdrawal nozzle such that the yarn essentially loses contact with the yarn contact surface of the yarn withdrawal nozzle over a deflection distance in the direction of the yarn withdrawal and over an angular extent in the circumferential direction of the yarn withdrawal nozzle of at least about 10 degrees.

This yarn withdrawal nozzle not only causes a controllable complete interruption of the false twist formation, but even a removal of the false twist present in the yarn tail. The yarn pulling force of the rotating yarn tail is diminished to approximately zero simultaneously with the drop of the false twist moment. As tests have shown, this removal of the false twist in the short period of time surprisingly has no adverse effects on the spinning stability.

The fibers collected in the rotor groove make a transition from an essentially untwisted condition in the fiber collection groove into a twisted condition in a zone prior to the point at which the fibers separate from the groove. This area within the rotor groove is called a transition zone. When the yarn, and therefore the transition zone, passes through the area of fiber feed into the rotor groove, and when the fibers are tied up in this zone, the probability of the formation of wrap fibers increases. By means of a yarn withdrawal nozzle in accordance with the invention, the transition zone can be shortened at the location of the fiber delivery to the rotor groove to such an extent that it becomes possible to considerably reduce the formation of wrap fibers or belly bands. The interruption of the contact of the yarn tail with the yarn withdrawal nozzle leads to a brief change, or reduction, of the twisting of the yarn tail and to a displacement of the force equilibrium between the yarn twist moment and section modulus in the rotor groove, without adversely affecting the spinning stability in the course of this operation.

A considerable variety of changes in the structure of the yarn can be achieved as desired by means of this open-end rotor spinning arrangement in a simple and reproducible manner, and therefore a corresponding increase may be realized in the applications in which the rotor yarns spun in this manner may be employed.

With the design of the yarn withdrawal nozzle in accordance with the present invention, a sufficient angular area in the circumferential direction of the yarn withdrawal nozzle, and therefore a sufficient amount of time in which the contact between the traveling yarn and the surface of the yarn withdrawal nozzle is interrupted in the deflection area of the yarn and during which no further false twist is created, is provided in order to permit an effective reduction in the increased twisting of the yarn tail between the rotor groove and the yarn withdrawal nozzle. Since the processes occur during very short periods of time, the inertia of the mass of the yarn and its elastic properties also have a retarding effect in the course of the twist compensation and with the shortening of the transition zone. With the embodiment of the yarn withdrawal nozzle in accordance with the present invention, the process of the twist compensation and the shortening of the transition zone is neither interrupted nor disturbed during the interruption of the yarn contact with the yarn withdrawal nozzle.

A preferred embodiment of the depression in the yarn withdrawal nozzle effects the complete separation of the yarn from the contact surface of the yarn withdrawal nozzle as suddenly as possible, as well as over a longer period of time, but without the impact of the yarn producing any undesired disturbances. A lateral face of the depression forms an abrupt offset with respect to the yarn contact surface of the yarn withdrawal nozzle to form an edge, such that the yarn in its movement cannot follow the contour of the surface of the yarn withdrawal nozzle and is separated from the surface of the yarn withdrawal nozzle. The shape of the edge can be designed in such a way that an undercut is formed. Matching of the curvature of the edge to the curvature of the yarn tail makes possible an extensive simultaneous separation of the yarn from the surface, and in this way avoids a delay of the complete interruption of yarn contact. It is possible by means of the structural design of the depression, for example by means of a convex design of the shape of the lateral face, to affect the desired yarn structure, the parameters of the yarn, as well as the finished textile article.

A yarn withdrawal nozzle wherein the angular relationship of the depression with respect to the mouth of the fiber guide conduit may be changeable into different fixed dispositions during the spinning process, can be universally employed, and the position of the depression can be adapted to the respectively changed spinning requirements in case of a batch change.

Alternatively, in connection with yarn withdrawal nozzles which unavoidably take up a predetermined position when installed, an exchange of the yarn withdrawal nozzle in the course of matching the respective spinning requirements can be performed rapidly, exactly and dependably.

A yarn withdrawal nozzle made of a ceramic material assures the maintenance of the desired shape, in particular of the depression edge, and therefore the maintenance of the desired effect over an extremely long period of time.

Besides the significantly reduced number of wrap fibers, yarns spun by means of the yarn withdrawal nozzles in accordance with the present invention have a clearly changed looser yarn structure. The remaining parameters of these yarns are similar to those of yarns spun by means of a smooth withdrawal nozzle. Limitations in the employment of rotor-spun yarns as opposed to ring-spun yarns, caused by the harder touch and clearly reduced hairiness of conventional rotor-spun yarns, are effectively overcome by means of this invention. The looser yarn structure instead opens new areas of employment, wherein voluminous and soft yarns are preferably used, to the rotor-spun yarns produced in this manner.

Further details, features and advantages of the present invention will be understood from the following disclosure of preferred embodiments of the present invention with reference to the accompanying drawing figures.

DETAILED DESCRIPTION OF THE PREFERRED EMBODIMENTS

Figure 1:
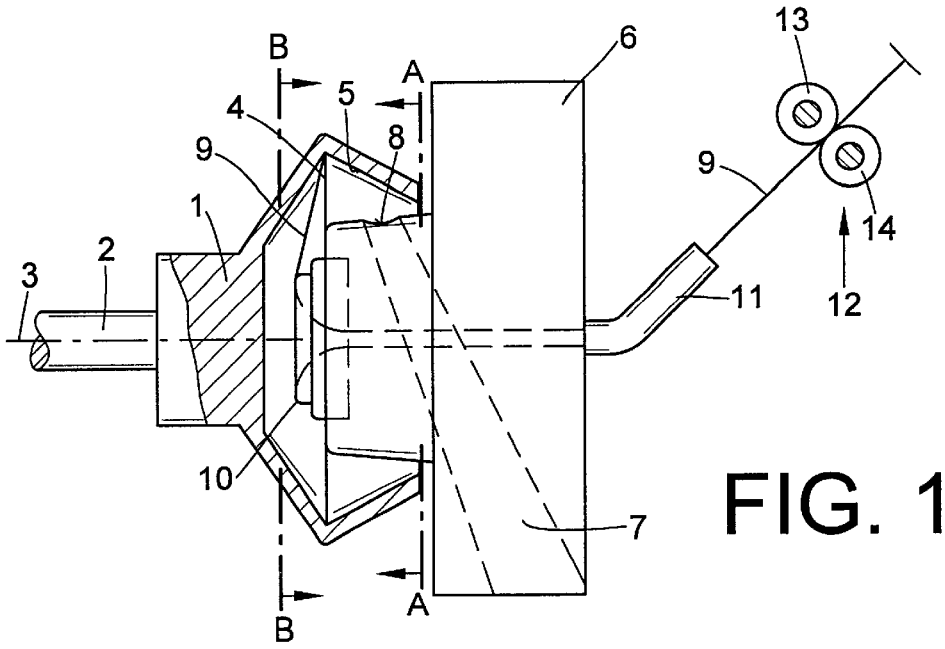
FIG. 1 is a simplified partial view of an open-end rotor spinning arrangement with a yarn withdrawal nozzle in accordance with the present invention, shown partially in side elevation and partially in axial cross-section.

The spinning rotor 1 represented in FIG. 1 has a shaft 2 with an axis of rotation identified by 3, a rotor groove 4 and a fiber sliding surface 5 in the interior of the spinning rotor 1. A rotor cover 6 has a fiber guide conduit 7 with a mouth 8 directed onto the fiber sliding surface 5. The fibers collected in the rotor groove 4 are withdrawn in the form of a yarn 9 by means of a withdrawal device 12 having a pair of withdrawal rollers 13, 14 which pull the yarn 9 through a yarn withdrawal nozzle 10 fastened on the rotor cover 6 and then through a small yarn withdrawal tube 11.

Figure 2:
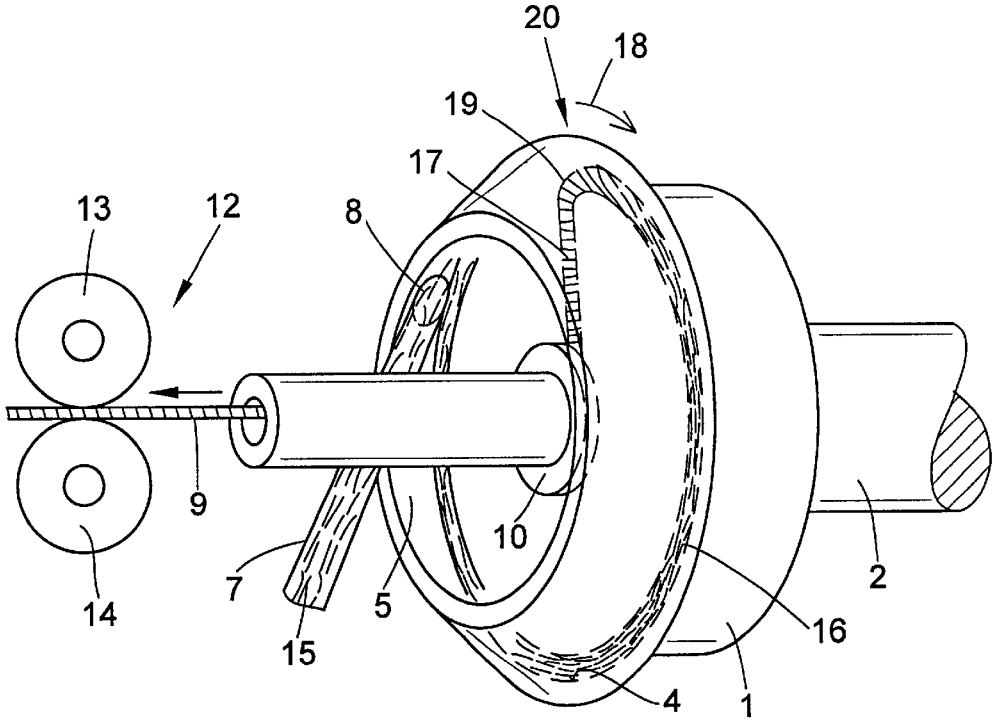
FIG. 2 is a perspective view basically representing the process of yarn formation in an open-end spinning rotor such as that of FIG. 1.

For further explanation of the spinning process, FIG. 2 shows a basic sketch of the open-end spinning arrangement in a perspective representation. The individual fibers 15 are transported through the fiber guide conduit 7 into the interior of the spinning rotor 1 and exit at the mouth 8 of the fiber guide conduit 7 onto the fiber sliding surface 5 of the spinning rotor 1. For a better representation of the path of the fibers 15, portions of the open-end spinning arrangement have been represented as being transparent in FIG. 2. The fibers 15 lie in an essentially stretched extended condition on the fiber sliding surface 5 and, because of the effects of the centrifugal force created by the rotation of the rotor 1, progress into the rotor groove 4, in which the fibers collect with one another in a ring of fibers 16. An actual twisting is imposed on the forming yarn 9 between the rotating spinning rotor 1, which acts in effect as a rotating yarn clamp, and the pair of withdrawal rollers 13, 14, which likewise acts as a yarn clamping location. The yarn 9 clamped between the withdrawal rollers 13, 14 is deflected by approximate 90 degrees at the yarn withdrawal nozzle 10. Because of the rotation of the spinning rotor 1 and the angle imposed on the withdrawing portion of the yarn, the trailing tail of the yarn 17, rotates in the same direction of rotation 18 as the spinning rotor 1. If the withdrawal rollers 13, 14 pull the yarn 9 in the customary manner at a constant speed from the spinning rotor 1, an essentially uniform twist is imparted to the section of the yarn 9 between the withdrawal rollers 13, 14 and the separation point 19 from the rotor groove 4. The fibers 15 change from their untwisted condition in the collection 16 of fibers in the groove 4 to a twisted condition in a transition zone located in the rotor groove 4 adjoining the separation point 19. At the separation point 19, where the yarn 9 is drawn out of the rotor groove 4, the yarn 9 must have sufficient stability, and therefore be sufficiently twisted, so that it does not tear. Twisting at the separation point 19 can be increased by a false twist, which is created by the yarn tail 17 rolling on the surface of the yarn withdrawal nozzle 10.

As the yarn 9 is being withdrawn from the spinning rotor 1, the separation point 19 progresses in the same direction of rotation as the direction of rotation 18 of the spinning rotor 1. The length of the transition zone 20 is a function of several factors, e.g., the preset yarn twisting and number of revolutions of the rotor and of the amount of false twist.

Figure 3:
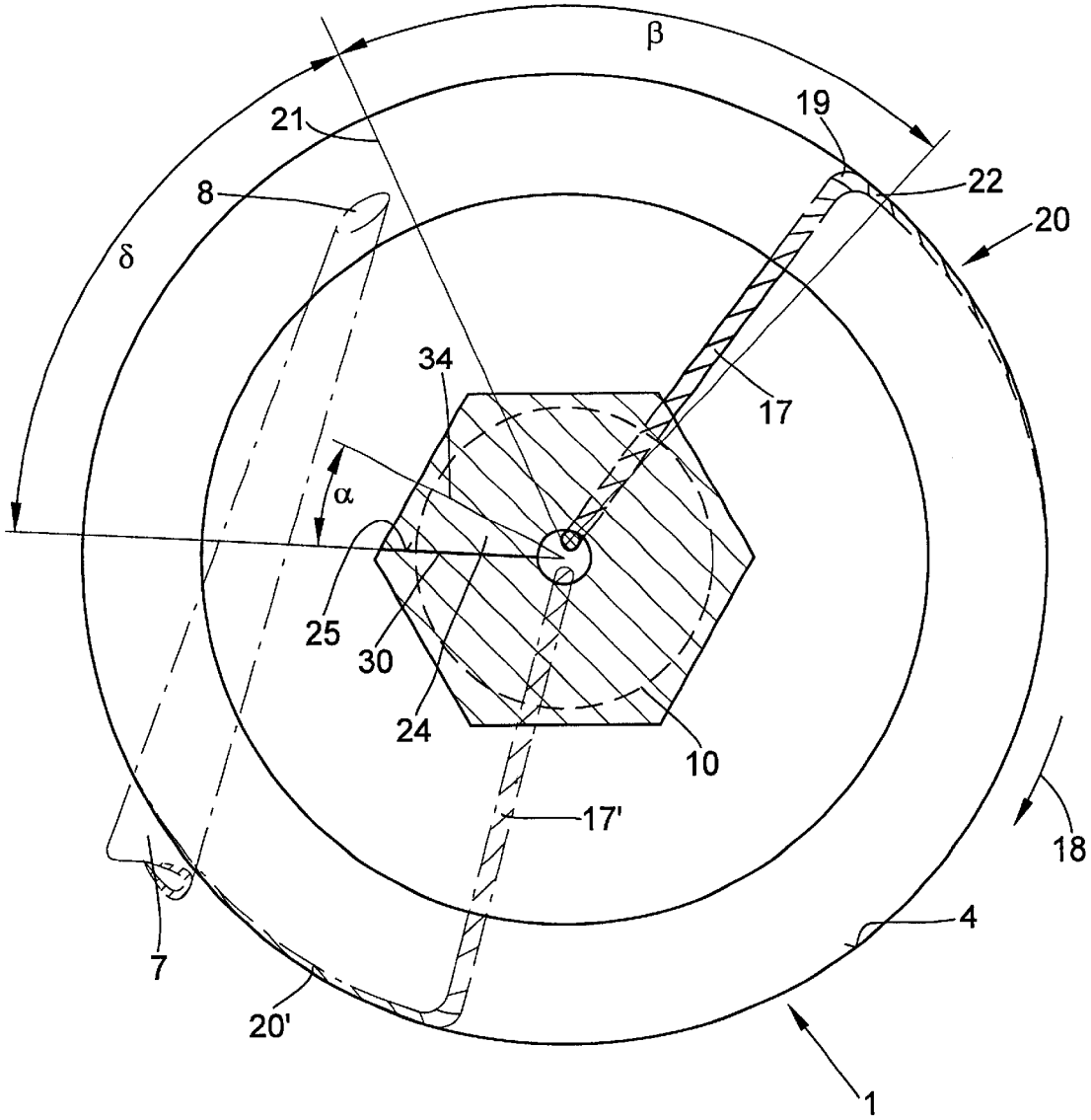
FIG. 3 is a cross-sectional view of the open-end spinning rotor and the yarn withdrawal nozzle of FIG. 1, taken along section line A—A therein.
Figure 4:
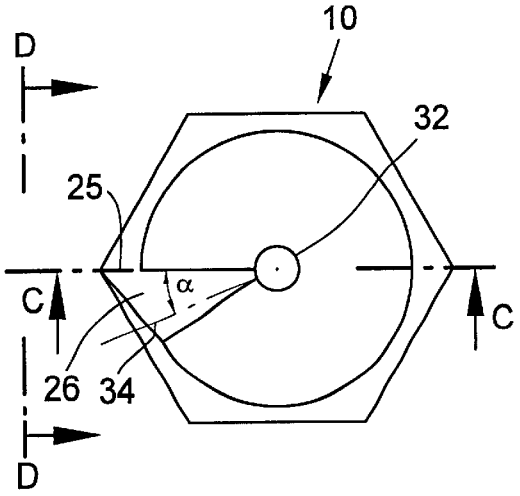
FIG. 4 is a cross-sectional view of the open-end spinning rotor and the yarn withdrawal nozzle of FIG. 1, taken along section line B—B therein, showing the yarn withdrawal nozzle in end elevation.
Figure 5:
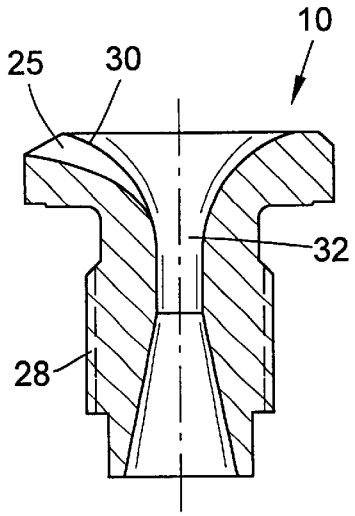
FIG. 5 is an axial cross-sectional view of the yarn withdrawal nozzle of FIG. 4, taken along line C—C thereof.
Figure 7:
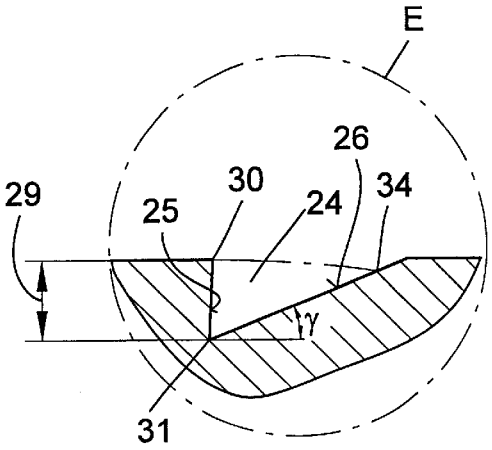
FIG. 7 is an enlarged cross-sectional view of the depression in the yarn withdrawal nozzle of FIG. 4, shown area E of FIG. 6, FIGS. 8 to 13 show simplified representations of further variations of the depression, in addition to that of the embodiment shown in FIG. 7.
Figure 6:
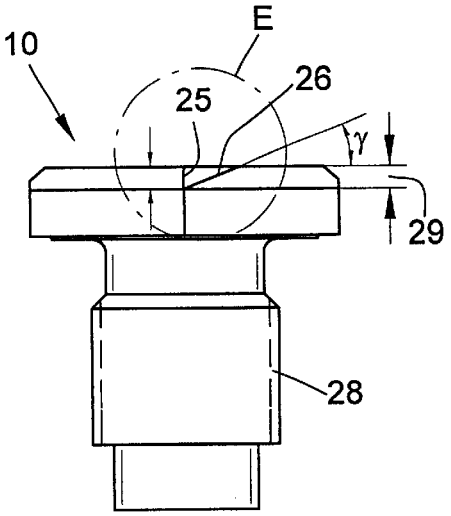
FIG. 6 is a side elevational view of the yarn withdrawal nozzle of FIG. 4, as viewed form line D—D thereof.
Figure 8:
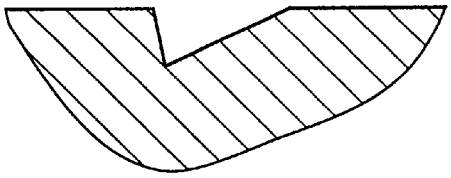
Figure 9:
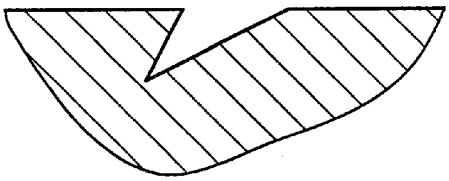
Figure 10:
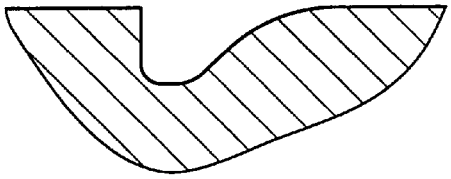
Figure 11:
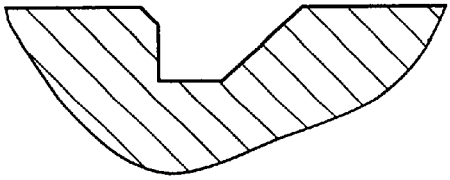
Figure 12:
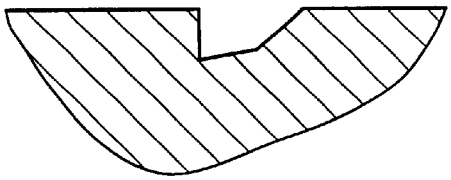
Figure 13:
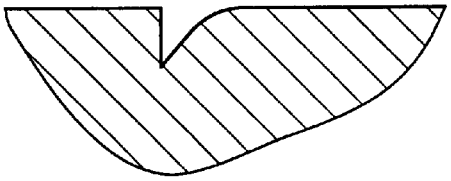

The exemplary embodiment in FIG. 3 represents a plan view in the direction of the rotor interior. A rotor of the type S 246 BD of W. Schlafhorst & Co. is used as a spinning rotor 1 at a number of revolutions n=63,000 rpm. The fiber slide area is 65 degrees. The fiber slide area is the angled area between the point of fiber delivery 21 into the spinning rotor and the point of fiber delivery 22 into the rotor groove 4. Cotton yarns of a fineness Tt yarn=30 tex are spun in the exemplary embodiment. Further spinning parameters are:

Fiber material: 100% cotton

Sliver denier: 3.42 ktex

Spinning vacuum: 75 mbar

Draft: 114

A yarn withdrawal nozzle 10 as represented in FIGS. 4 to 7 is used. Preferably, the yarn withdrawal nozzle 10 is made of a ceramic material. On its surface facing the spinning rotor 1, the yarn withdrawal nozzle 10 has a depression 24 (FIGS. 3 and 7), having stepped lateral face 25 which abruptly extends in the yarn circulating direction at an angle of 90 degrees in respect to the surface and having a slowly rising lateral face 26 to form the depression 24. The lateral surface 26 rises in the yarn circulating direction at an angle of 20.5 degrees. The yarn withdrawal nozzle 10 has an exterior thread 28, by means of which the yarn withdrawal nozzle 10 is rotatably inserted in a correspondingly designed interior thread (not shown for reasons of simplicity) in the rotor cover 6. The distance a, identified by 29, between the edge 30 and the lowest point 31 at the bottom of the depression 24 is 1.5 mm in the exemplary embodiment.

The yarn 9 withdrawn through the yarn guide conduit 32 of the yarn withdrawal nozzle 10 rotates with its yarn tail 17 in the direction of rotation 18 and in the process crosses the edge 30 during each revolution. In the course of the yarn tail movement indicated by broken lines in FIG. 7, the yarn 9 cannot follow the contour of the surface of the yarn withdrawal nozzle 10 at the edge 30 and loses contact with the surface in an angled area a of 25 degrees. At an impact point 34, the yarn 9 again makes contact with the surface of the yarn withdrawal nozzle 10. An essentially complete stop of false twist formation in the section of the yarn 9 between the separation point 19 and the withdrawal rollers 13, 14 occurs during this loss of contact with the yarn withdrawal nozzle 10. The yarn tensioning force of the rotating yarn tail 17 is simultaneously diminished to approximately zero. A twisting compensation takes place within this yarn section, by means of which the torque applied at the separation point 19 is significantly reduced. The reduced torque results in a shortening of the transition zone 20.

At the spinning conditions applicable for the exemplary embodiment, it has been shown that the transition zone 20 at the location of fiber feed 21 into the rotor groove 4 is reduced to a minimum if the position of the edge 30, i.e. the beginning of the depression 24, is offset in the circulating direction of the yarn by an angle of 65 degrees counter-clockwise in respect to the location of the point of fiber delivery 21, and therefore to the location of the mouth 8 of the fiber guide conduit 7.

In the exemplary embodiment, the minimized transition zone 20 occurs when the circulating yarn tail 17 passes fiber feed location 22. The formation of wrap fibers is clearly thereby reduced and the yarn becomes more similar to ring-spun yarn. Because of the oscillations of the yarn tensioning force induced by the contact interruption, the yarn structure becomes looser, and the production of finished textile articles which are softer to the touch is made possible. It is indicated by means of the broken-line yarn tail 17' (FIG. 3) that a considerably longer transition zone 20' exists in the rotor groove 4 outside of the zone of fiber delivery 22. A transition zone 20, 20' is created by means of the described embodiment of the depression 24, which greatly varies in length over the circumference of the spinning rotor 1 and which is shorter by a multiple in the area of fiber feed location 22 into the rotor groove 4 than on the remaining circumference. In this manner, the formation of wrap fibers is suppressed on the one hand, and on the other a sufficiently great spinning stability is provided.

FIGS. 8 to 13 show in greatly simplified presentations different variants of a depression 24. In the alternative embodiments represented, the angular position of the lateral faces 25 and 26 can vary. The shape of the lateral face 26 can be designed to be convex. The edges 30 of the step can be with or without ridges, sharply broken, or rounded with a radius. The bottom of the depression 24 can be rounded by means of a transition or can be angular.

Figure 14:
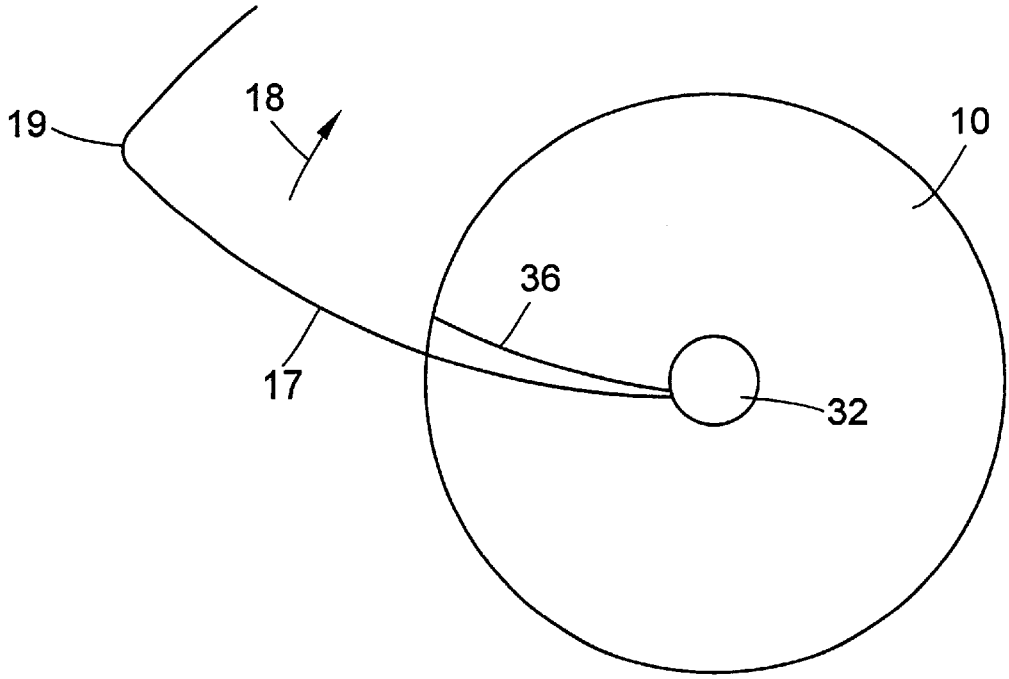
FIG. 14 is an end elevational view of a yarn withdrawal nozzle of the present invention showing schematically an embodiment wherein an edge of the depression is matched to the curvature of the yarn tail.

FIG. 14 shows a yarn withdrawal nozzle 10 with a step-shaped edge 36, whose radial extent is curvilinear in correspondence to the curvature in which the yarn tail 17 extends while circulating in the direction of rotation 18. During the spinning operation, the course of the yarn tail 17 between the separation point 19 and the yarn guide conduit 32 is formed as a function of the spinning settings and the raw fiber materials. By matching of the radial extent of the edge 36 to the curvature of the yarn tail 17, the yarn tail 17 suddenly and simultaneously loses contact with the surface of the yarn withdrawal nozzle 10. The twist compensation can take place without delay and unhampered.

The yarn 9 can be lifted completely off the surface of the yarn withdrawal nozzle 10 in a temporarily limited and locally pre-determinable manner by means of the yarn withdrawal nozzles 10 of the invention. The yarn withdrawal nozzle 10 is designed such that the depression 24 extends into the mouth opening or into the yarn guide conduit 32 of the yarn withdrawal nozzle 10. In the course of each sweep over the depression 24, the formation of false twists is completely interrupted. The twist buildup at the surface of the yarn withdrawal nozzle 10 is simultaneously cancelled, and the yarn tensioning force is diminished down to values of Fmin=10 cN. These changed spinning conditions lead to a short-term reduction of the twist distribution in the yarn, because of which the force equilibrium between the yarn twist moment and section modulus in the rotor groove is displaced. The oscillations of the yarn tensioning force induced by the diminishing yarn tensioning force are very short and of high frequency and do not adversely affect the spinning stability.

If the depression 24, or the area of the contact interruption, is positioned in such a way that a reduced transition zone 20 is generated when the yarn passes the area of feeding fiber 22, the formation of belly bands is significantly suppressed, and the yarns have a looser yarn structure and a clearly reduced number of wrap fibers. The yarns have yarn parameters which are comparable with yarns spun by means of a smooth yarn withdrawal nozzle, but can be considerably hairier. The open yarn structure, along with otherwise similar yarn parameters, makes new areas of employment for rotor-spun yarns possible, wherein preferably voluminous and soft yarns are processed.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. An open-end spinning arrangement having a rotatable spinning rotor, a fiber guide conduit with an exit mouth for delivery of spinning fibers into the spinning rotor, a yarn withdrawal nozzle for withdrawing a yarn formed of the fibers from a transition zone within the spinning rotor and simultaneously for rollingly and slidingly deflecting the yarn over a yarn contact surface of the yarn withdrawal nozzle to impart a false twist thereto, the yarn withdrawal nozzle having means for reducing the false twist within a zone extending over a circumferential portion of the yarn withdrawal nozzle, the false twist reducing means and the exit mouth of the fiber guide conduit being arranged relative to the direction of the rotor rotation such that actual twisting of the yarn is reduced thereat, the false twist reducing means comprising a depression in the yarn contact surface of the yarn withdrawal nozzle which is abruptly offset in the circumferential direction of the yarn withdrawal nozzle and which has a depth and an extent in the circumferential direction of the yarn withdrawal nozzle such that the yarn essentially loses contact with the yarn contact surface of the yarn withdrawal nozzle over a deflection distance in the direction of the yarn withdrawal and over an angular extent in the circumferential direction of the yarn withdrawal nozzle of at least about 10 degrees.

2. The open-end rotor spinning arrangement in accordance with claim 1, wherein the depression is asymmetrical, the depression having a first lateral face at a leading edge of the depression as viewed in the circumferential direction of the yarn withdrawal nozzle, the first lateral face extending transversely away from the yarn contact surface of the yarn withdrawal nozzle, and the depression having a second lateral face following the first lateral face at a trailing edge of the depression as viewed in the circumferential direction of the yarn withdrawal nozzle, the second lateral face extending transversely toward the yarn contact surface of the yarn withdrawal nozzle, such that the yarn cannot follow the contour of the yarn contact surface of the yarn withdrawal nozzle at the depression.

3. The open-end rotor spinning arrangement in accordance with claim 1, wherein the depression extends essentially radially relative to the circumferential direction of the yarn withdrawal nozzle.

4. The open-end rotor spinning arrangement in accordance with claim 2, wherein the leading edge of the depression has a curvature corresponding to the curvature of the extent of the yarn in contact with the yarn contact surface of the yarn withdrawal nozzle.

5. The open-end rotor spinning arrangement in accordance with claim 2, wherein the distance between the leading edge of the depression and a bottom of the depression is between about 1 mm and about 3 mm.

6. The open-end rotor spinning arrangement in accordance with claim 1, wherein the yarn withdrawal nozzle has only one single depression.

7. The open-end rotor spinning arrangement in accordance with claim 2, wherein the second lateral face of the depression is essentially convex.

8. The open-end rotor spinning arrangement in accordance with claim 1, wherein the mouth of the fiber guide conduit has a changeable angular disposition relative to the depression.

9. The open-end rotor spinning arrangement in accordance with claim 1, wherein the angular extent is between about 15 degrees and about 25 degrees.

10. The open-end rotor spinning arrangement in accordance with claim 1, wherein the yarn withdrawal nozzle is made of a ceramic material.

* * * * *